US012297601B2

(12) United States Patent
Vishtal et al.

(10) Patent No.: US 12,297,601 B2
(45) Date of Patent: May 13, 2025

(54) PAPER-BASED FLEXIBLE PACKAGING MATERIAL WITH HIGH BARRIER PROPERTIES AND A PROCESS TO PRODUCE IT

(71) Applicant: SOCIETE DES PRODUITS NESTLE S.A., Vevey (CH)

(72) Inventors: Alexey Vishtal, Lausanne (CH); Hock Seng Gordon Soh, Punggol Drive (SG); Yves Roger Wyser, Forel (CH)

(73) Assignee: Societe des Produits Nestle S.A., Vevey (CH)

( * ) Notice: Subject to any disclaimer, the term of this patent is extended or adjusted under 35 U.S.C. 154(b) by 225 days.

(21) Appl. No.: 17/904,127

(22) PCT Filed: Feb. 17, 2021

(86) PCT No.: PCT/EP2021/053837
§ 371 (c)(1),
(2) Date: Aug. 12, 2022

(87) PCT Pub. No.: WO2021/165292
PCT Pub. Date: Aug. 26, 2021

(65) Prior Publication Data

US 2023/0123531 A1 Apr. 20, 2023

(30) Foreign Application Priority Data

Feb. 17, 2020 (EP) ..... 20157789

(51) Int. Cl.
*D21H 27/10* (2006.01)
*D21H 19/38* (2006.01)
(Continued)

(52) U.S. Cl.
CPC ..... *D21H 27/10* (2013.01); *D21H 19/385* (2013.01); *D21H 19/828* (2013.01); *D21H 23/30* (2013.01); *D21H 23/50* (2013.01)

(58) Field of Classification Search
CPC .... D21H 27/10; D21H 19/385; D21H 19/828; D21H 23/30; D21H 23/50; D21H 19/02; D21H 19/08; D21H 19/82; D21H 19/824
See application file for complete search history.

(56) References Cited

U.S. PATENT DOCUMENTS

2012/0251818 A1* 10/2012 Axrup ..... D21H 27/10 428/326
2014/0205905 A1* 7/2014 Xiao ..... H01M 4/049 429/231.5

FOREIGN PATENT DOCUMENTS

WO 2009112255 9/2009
WO 2011078770 6/2011
WO WO-2011078770 A1 * 6/2011 ..... B32B 15/085

* cited by examiner

*Primary Examiner* — Dennis R Cordray
*Assistant Examiner* — Matthew M Eslami
(74) *Attorney, Agent, or Firm* — K&L Gates LLP

(57) ABSTRACT

The present invention relates generally to the field of polymer dispersion coated, paper-based flexible packaging materials. In particular, the present invention relates to improving the barrier properties of polymer dispersion coated 5 paper-based flexible packaging materials. Embodiments of the present invention relate to a process for improving the barrier properties of polymer dispersion coated paper-based flexible packaging materials comprising the step of applying an Al2O3 coating to at least one surface of the dispersion coated paper-based flexible packaging materials, for example by using atomic layer deposition; and an Al2O3-coated paper material 10 obtainable by such a process.

7 Claims, 1 Drawing Sheet

| Substrate | Target $Al_2O_3$ thickness (nm) | Plasma Pre-treatment | Original WVTR at 38°C 90% RH ($g/m^2/d$) | average WVTR after ALD ($g/m^2/d$ ) |
|---|---|---|---|---|
| Paper A | 50 | none | 3 | 0.7 |
| Paper B | 50 | none | ca. 250 | 40.5 |
| Paper A | 25 | plasma | 3 | 0.48 |
| Paper A | 25 | none | 3 | 0.2 |

(51) Int. Cl.

| | |
|---|---|
| ***D21H 19/82*** | (2006.01) |
| ***D21H 23/30*** | (2006.01) |
| ***D21H 23/50*** | (2006.01) |

| Substrate | Target $Al_2O_3$ thickness (nm) | Plasma Pre-treatment | Original WVTR at 38°C 90% RH ($g/m^2/d$) | average WVTR after ALD ($g/m^2/d$ ) |
|---|---|---|---|---|
| Paper A | 50 | none | 3 | 0.7 |
| Paper B | 50 | none | ca. 250 | 40.5 |
| Paper A | 25 | plasma | 3 | 0.48 |
| Paper A | 25 | none | 3 | 0.2 |

PAPER-BASED FLEXIBLE PACKAGING MATERIAL WITH HIGH BARRIER PROPERTIES AND A PROCESS TO PRODUCE IT

CROSS REFERENCE TO RELATED APPLICATIONS

The present application is a National Stage of International Application No. PCT/EP2021/053837, filed on Feb. 17, 2021, which claims priority to European Patent Application No. 20157789.7, filed on Feb. 17, 2020, the entire contents of which are being incorporated herein by reference.

FIELD OF THE INVENTION

The present invention relates generally to the field of polymer dispersion coated, paper-based flexible packaging materials. In particular, the present invention relates to improving the barrier properties of polymer dispersion coated paper-based flexible packaging materials. Embodiments of the present invention relate to a process for improving the barrier properties of polymer dispersion coated paper-based flexible packaging materials comprising the step of applying an $Al_2O_3$ coating to at least one surface of the dispersion coated paper-based flexible packaging materials, for example by using atomic layer deposition; and an $Al_2O_3$-coated paper material obtainable by such a process.

BACKGROUND OF THE INVENTION

Plastic packaging materials are used frequently in economy and in people's daily lives. It has multiple advantages, such as its flexibility, barrier properties, sealability, and relatively low basis weights needed to achieve afore mentioned functionalities. Such a weight reduction contributes to fuel saving and CO2 reduction during transport, for example. Its barrier properties help to reduce food waste due a positive effect on increasing shelf life. The barrier properties also help to secure food safety.

However, according to the European strategy for plastics in a circular economy, recently published by the European Commission, around 25.8 million tons of plastic waste are generated in Europe every year with less than 30% of such waste being collected for recycling and between 150 000 to 500 000 tons of plastic waste entering the oceans every year.

To ensure that plastic waste is reduced, significant efforts are made in the industry and in commerce. Several supermarkets replace plastic bags by paper based bags, for example. However, replacing plastics with paper in long-shelf life barrier food packaging is not an easy task. A change in packaging material must not compromise consumer and food safety. The packaging must serve to protect the food, but must also be robust enough to be handled by machines during the production process, and must allow that the food product is presented effectively.

Hence, there is a need for paper materials with improved barrier properties. Today, the barrier properties of paper materials are typically improved by laminating of paper with plastic films and aluminium. Such plastics can comprise polyethylene (PE), polyethylene terephthalate (PET), polypropylene (PP), or biopolymers (PLA), metallized cellophane for example. However, lamination of paper is usually harmful for its repulpability and hence, recyclability. The reason is, applying a layer of plastic by known techniques, in particular by extrusion (extrusion-lamination or extrusion coating) necessarily provides a high thickness of the plastic film thus obtained by lamination (or extrusion) onto the paper.

The second issue with extruded polymers is that even for the lowest thicknesses of polymer applied to a substrate, the cohesive strength of the polymer film is very high and the level of adhesion of the polymer to the substrate is also high. This prevents such polymer to detach from the substrate when recycled, and prevents recycling and repulping of the cellulose portion in a paper-stream recycling process.

Therefore, later during the recycling process, the paper cannot be recycled in a paper-stream recycling process because the plastic layer is too thick, to strong, and adheres too much to the cellulosic substrate to be dissolved and separated from the paper fibres: the thick laminated or extruded plastic film remains intact within the paper pulp bath, hence making it impossible to recycle a "clean" paper pulp from the repulping process.

Another emerging way to improve barrier properties of paper is to coat paper with water-based polymer dispersions such as styrene-butadiene, acrylate, PVDC, polyurethane, etc. In this case, if the coating weight of applied polymer is low enough, repulpability of paper is not adversely affected.

However, there is a need in the art to even further improve the barrier properties of a paper based packaging material.

It would therefore be desirable to provide the art with a process that allows it to improve the barrier properties of polymer dispersion coated paper-based flexible packaging materials; and with a dispersion coated paper-based flexible packaging material obtainable by such a process that can still be recycled in a conventional paper recycling process.

Any reference to prior art documents in this specification is not to be considered an admission that such prior art is widely known or forms part of the common general knowledge in the field.

The objective of the present invention is to improve the state of the art and in particular to provide a process that allows it to improve the barrier properties of polymer dispersion coated paper-based flexible packaging materials; and a paper material obtainable by such a process, or to at least to provide a useful alternative.

SUMMARY OF THE INVENTION $Al_2O_3$ coatings are currently mainly used for the coating of metal and polymeric surfaces, for example to improve wear resistance, thermal barrier and anti-corrosive properties, or water vapor barrier properties; see for example, Materials Characterization, Volume 62, Issue 1, January 2011, Pages 90-93.

The major weakness of aluminium oxide coatings, however, is their susceptibility to cracking and spalling, as well as specific demands to the porosity, smoothness and surface energy of the underlying material.

The inventors were surprised to see that applying an $Al_2O_3$ coating to at least one surface of a dispersion coated paper-based flexible packaging material allowed to achieve the objective of the present invention and that—consequently—the objective of the present invention could be achieved by the subject matter of the independent claims. The dependent claims further develop the idea of the present invention.

Accordingly, the present invention provides a process for improving the barrier properties of polymer dispersion coated, paper materials comprising the step of applying an $Al_2O_3$ coating to at least one surface of the dispersion coated paper-based flexible packaging material, for example by atomic layer deposition.

The present invention further provides an $Al_2O_3$-coated paper material obtainable by such a process.

As used in this specification, the words "comprises", "comprising", and similar words, are not to be interpreted in an exclusive or exhaustive sense. In other words, they are intended to mean "including, but not limited to".

The present inventors have shown that applying an $Al_2O_3$ coating to at least one surface of a dispersion coated paper-based flexible packaging material allowed it to improve its barrier properties. In particular, the inventors could show that while the application of an $Al_2O_3$ coating to at least one surface of a dispersion coated paper-based flexible packaging material allowed it in general to improve its barrier properties; an $Al_2O_3$ coating with a thickness in the range 20-30 nm applied to at least one surface of a dispersion coated paper-based flexible packaging material allowed it to improve the barrier properties of the dispersion coated paper-based flexible packaging material particularly well, if the dispersion coated paper-based flexible packaging material was not plasma pre-treated; and an $Al_2O_3$ coating with a thickness in the range 45-55 nm applied to at least one surface of a dispersion coated paper-based flexible packaging material allowed it to improve the barrier properties of the dispersion coated paper-based flexible packaging material particularly well, if the dispersion coated paper-based flexible packaging material was plasma pre-treated.

DETAILED DESCRIPTION OF THE INVENTION

Figures 1, 2:
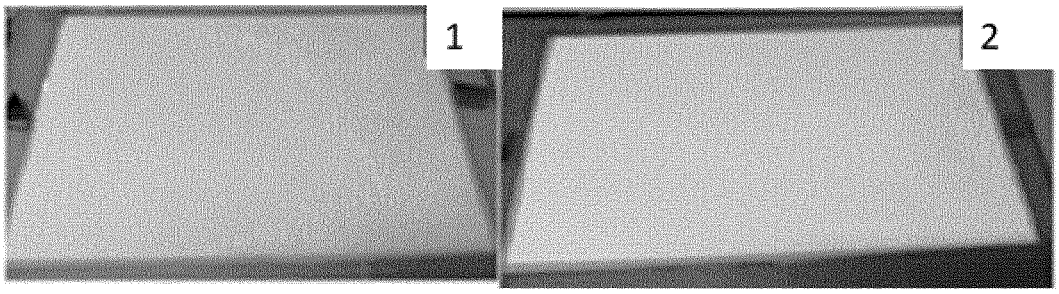
FIG. 1 shows different substrates for deposition: 1) Paper B, 2) Paper A.
FIG. 2 shows a table with the depositions and WVTR for each substrate.

Consequently, the present invention relates in part to a process for improving the barrier properties of polymer dispersion coated paper-based flexible packaging materials comprising the step of applying an $Al_2O_3$ coating to at least one surface of the dispersion coated paper-based flexible packaging material.

For the purpose of the present invention a packaging material may be considered "paper-based", if it contains cellulose fibres. Additionally or alternatively, it may be considered paper-based if it contains at least 50 weight %, at least 60 weight %, at least 70 weight %, at least 80 weight %, or at least 90 weight % of cellulosic fibres.

For the purposes of the present invention, a paper-based packaging material shall be considered flexible, if it is a material capable of bending without breaking. Further, for example, such a flexible material may be a material that can be bent without breaking by hand. Typically, a paper-based flexible packaging material in accordance with the present invention may have a basis weight of 140 g/m2 or less.

The paper-based flexible packaging material of the present invention may be a packaging material for a food product. It may be a primary packaging material, a secondary packaging material or a tertiary packaging material, for example. If the paper material is a packaging material for a food product, a primary packaging material for a food product may be a packaging material for a food product that is in direct contact with the actual food product. A secondary packaging material for a food product may be a packaging material for a food product that helps secure one or more food products contained in a primary packaging. Secondary packaging material is typically used when multiple food products are provided to consumers in a single container. A tertiary packaging material for a food product may be a packaging material for a food product that helps secure one or more food products contained in a primary packaging and/or in a primary and secondary packaging during transport.

For some applications of the present invention it may be preferred if the polymer dispersion coated paper-based flexible packaging material is non-porous. The ratio of pore volume to total volume of the paper material is called the porosity of the paper material. For the purpose of the present invention, a paper material shall be considered as non-porous if it has a porosity of less than 40%, for example, less than 30% or less than 20%. Additionally or alternatively, as porosity can also be measured via the air permeability of the material that is tested, the paper material described in the present invention may have an air permeability of less than 10 ml/min. Hence, in one embodiment of the present invention, the paper material is non-porous paper material.

Barrier properties of paper materials are well known to the person skilled in the art. If the paper material is a packaging material for a food product, for example, such good barrier properties are essential for maintaining the safety and quality of packaged foods. Typically, such barrier properties include gas permeability, for example $O_2$, $CO_2$, and $N_2$; vapor permeability, for example water vapor; liquid permeability, for example water or oil; aroma permeability; and light permeability.

Coating paper materials, such as paper packaging materials, with polymer dispersions, e.g., to improve the barrier properties of the paper material, is well known in the art. Examples are, for example described in Kimpimäki T., Savolainen A. V. (1997) Barrier dispersion coating of paper and board. In: Brander J., Thorn I. (eds) Surface Application of Paper Chemicals. Springer, Dordrecht. coated, paper materials. As polymers, typically modified ordinary styrene-butadienes, acrylates, polyurethanes, waxes, polyvinylidene dichloride, native and modified starches, nitrocellulose, methacrylates, polyolefins, vinylene acetates, natural biopolymers, modified biopolymers or copolymers or combinations of these may be used. One advantage of such dispersion coatings is that papers coated with these materials are usually recyclable.

For the purpose of the present invention, the dispersion coating may be, for example, one or a plurality of layers comprising acrylic acid copolymers, polyesters, polyhydroxyalkanoates, native and chemically modified starches, xylan and chemically modified xylan, polyvinylidene dichloride, polyvinyl alcohol, ethyl-vinyl alcohol, vinyl acetate, ethyl-vinyl acetates, cellulose nitrate, waxes, microfibrillated cellulose, polyolefins, silanes, polyurethanes, or combinations thereof.

With a dispersion coating technology, the layer of dispersion-coated polymer onto the paper layer has a thickness which is comprised within a range of 1 μm to 10 μm, preferably within a range comprised between 3 μm and 7 μm. More preferably, the dispersion-coated layer of polymer has a thickness of about 5 μm. The thickness of the paper layer, prior to being coated with the dispersion coated polymer, is about 60 μm, and at least within the range otherwise provided in the present specification.

The process in accordance with the present invention comprises that an $Al_2O_3$ coating is applied to at least one surface of the dispersion coated paper-based flexible packaging material. The $Al_2O_3$ coating may be applied to the inner surface of the dispersion coated paper-based flexible packaging material, the outer surface of the dispersion coated paper-based flexible packaging material, or both surfaces. If the dispersion coated paper-based flexible packaging material is dispersion coated only on the inner surface of the paper material or only on the outer surface of the paper material, the $Al_2O_3$ coating may be applied to the surface of the paper material without the dispersion coating. Also, if the dispersion coated paper-based flexible packaging material is dispersion coated only on the inner surface of the paper material or only on the outer surface of the paper material, the $Al_2O_3$ coating may be applied to the surface of the paper material with the dispersion coating. Additionally or alternatively, the $Al_2O_3$ coating may be applied to the surface of the paper material under the dispersion coating. The present inventors have achieved particularly good results when the $Al_2O_3$ coating was be applied to the surface of the paper material on top of the dispersion coating. For applications, where particularly good barrier properties are needed, it may be preferred, if an $Al_2O_3$ coating is applied to both surfaces of the paper material.

The $Al_2O_3$ coating may be applied to at least one surface of the dispersion coated paper-based flexible packaging material by any method known in the art as far as they are suitable for coating paper based substrates. A person skilled in the art will be able to identify such methods. Typical methods to apply an $Al_2O_3$ coating to a polymer dispersion coated, paper materials include, for example, direct physical vapor deposition process or the transfer of AlOx from a PET substrate using a transfer adhesive.

The inventors were, however surprised, that they could achieve particularly good results by using atomic layer deposition (ALD). Consequently, in one embodiment of the present invention the $Al_2O_3$ coating is applied to the surface of the polymer dispersion coated paper-based flexible packaging material by atomic layer deposition.

ALD is a thin film technology that allows the uniform deposition of films with controllable thickness. The technique of ALD is reviewed in Sci Technol Adv Mater. 2019; 20(1): 465-496, herein incorporated by reference.

Recent work, Thin Solid Films, 2018, 666, pp. 20-27, describes a study of aluminum oxide thin films deposited by plasma-enhanced atomic layer deposition. Aluminum oxide ($Al_2O_3$) films were deposited on silicon substrates using plasma-enhanced atomic layer deposition technique with tri-methyl-aluminum TMA ($Al(CH_3)_3$) and oxygen ($O_2$) as precursors. To the inventors' best knowledge, it has never been described or suggested to use ALD for coating a surface of a polymer dispersion coated paper-based flexible packaging material with an $Al_2O_3$ coating.

Employing ALD has the advantage that very precise nanometer thick, pinhole free and conformal thin films can be applied to the surface of a polymer dispersion coated paper-based flexible packaging material.

The person skilled in the art will be able to adjust the ALD process parameters accordingly, to produce an optimal result. Typical process conditions in ALD are a pressure in the range of 0.1-10 mbar—atmospheric pressure may be used as well—and a temperature in the range of 50-500° C. The temperature must—of course be selected so that the polymer dispersion coated paper-based flexible packaging materials can withstand such a temperature.

For the purpose of the present invention, atomic layer deposition may be carried out at a temperature in the range of 40° C.-80° C. In terms of pressure, the atomic layer deposition may be carried out at a pressure in the range of 0.1-0.5 mbar. In order to produce an $Al_2O_3$ coating, trimethylaluminum (TMA) and $H_2O$ and/or $O_2$ may be used as precursors. Hence, in one embodiment of the present invention, the $Al_2O_3$ coating is applied to the surface of the polymer dispersion coated paper-based flexible packaging material by atomic layer deposition at a temperature in the range of 40° C.-80° C. with trimethylaluminum (TMA) and H2O as precursors. In another embodiment of the present invention, the $Al_2O_3$ coating is applied to the surface of the polymer dispersion coated paper-based flexible packaging material by atomic layer deposition at a temperature in the range of 40° C.-80° C. with trimethylaluminum (TMA) and $O_2$ as precursors.

When coating the polymer dispersion coated paper-based flexible packaging material with an $Al_2O_3$ coating in accordance with the present invention, the present inventors have obtained particularly good results if the $Al_2O_3$ coating had a thickness in the range of 8-70 nm. A thickness of the $Al_2O_3$ coating of less than 5 nm was found to sometimes have stability issues and the obtained barrier effect was rather low. A thickness of the $Al_2O_3$ coating of more than 75 nm was found to sometimes lead to a rather rigid coating with a chance of crack formation in the coating. Hence, in one embodiment of the present invention, the $Al_2O_3$ coating that is applied to the surface of the polymer dispersion coated paper-based flexible packaging material has a thickness in the range of 8-70 nm.

Further, the inventors have obtained particular good results when the $Al_2O_3$ coating had a thickness in the range of 45-55 nm or a thickness in the range of 20-30 nm. Hence, in one embodiment, the $Al_2O_3$ coating that is applied to the surface of the polymer dispersion coated paper-based flexible packaging material may have a thickness in the range of 45-55 nm. In another embodiment the $Al_2O_3$ coating that is applied to the surface of the polymer dispersion coated paper-based flexible packaging material may have a thickness in the range of 20-30 nm. Interestingly, an $Al_2O_3$ coating with a thickness in the range of 45-55 nm resulted in very good barrier properties, if the polymer dispersion coated paper-based flexible packaging material was plasma pre-treated. Hence, in a further embodiment, the $Al_2O_3$ coating that may be applied to the plasma-pre-treated surface of the polymer dispersion coated paper-based flexible packaging material may have a thickness in the range of 45-55 nm. An $Al_2O_3$ coating that is applied to the surface of the polymer dispersion coated paper-based flexible packaging material and has a thickness in the range of 20-30 nm was found to be in particular effective in improving the barrier properties of the polymer dispersion coated paper-based flexible packaging material, if the polymer dispersion coated paper-based flexible packaging material was not plasma-pretreated. Without wishing to be bound by theory, the inventors presently believe that this effect is observed because plasma pre-treatment might lead to some extent of damage to the surface of the polymer dispersion coated paper-based flexible packaging material that a thicker film is more likely to compensate for.

Any polymer dispersion coated paper-based flexible packaging material may be used for the purpose of the present invention. A person skilled in the art will be able to select the appropriate paper material based on the product to be packaged, the intended shelf life and whether the paper material is to be used as primary, secondary or tertiary packaging. Typically, however, the polymer dispersion coated paper-based flexible packaging material may have a grammage in the range of 40-120 g/m2, 50-100 g/m2, or 60-85 g/m2.

During atomic layer deposition (ALD) gas phase reactants are sequentially exposed for the deposition of atomic layer thin films. The atomic layers are formed by saturated surface controlled chemical reactions. A specific form of ALD is plasma-assisted atomic layer deposition (PA-ALD). PA-ALD includes a plasma-pre-treatment in between the reaction cycles. Such a plasma pre-treatment helps to improve the process efficiency, for example by improving reaction rates and removing product molecules. PA-ALD may be used for the purpose of the present invention. Hence, in one embodiment of the present invention the process comprises a plasma pre-treatment of the surface of the polymer dispersion coated paper-based flexible packaging material before the $Al_2O_3$ coating is applied. The plasma pre-treatment may be carried out at least once before the $Al_2O_3$ coating is applied and may be carried out at least before each $Al_2O_3$ application cycle.

The inventors have obtained particularly promising results if the plasma pre-treatment of the surface of the polymer dispersion coated paper-based flexible packaging material was carried out with $O_2$. For example, the plasma pre-treatment of the surface of the polymer dispersion coated paper-based flexible packaging material may be carried out with $O_2$ gas with a flow in the range of 250-300 ml/min, for example about 280 ml/min; at a base pressure in the range of 0.2 mbar-0.4 mbar, for example about 0.3 mbar; with a pulse time on/off in the range of 0.3-0.7 ms/2-3 ms, for example about 0.5/2.5 ms; and a total processing time in the range of 10 s-1500 s, for example about 1200 s.

If the process of the present invention is carried out with ALD to apply the $Al_2O_3$ coating, the process of the present invention may be carried out using a roll to roll method where the polymer dispersion coated paper-based flexible packaging material is travelling along nozzles attached to the drum performing the TMA addition by delivering trimethyl-aluminium TMA ($Al(CH_3)_3$) and oxygen ($O_2$) pulses and a termination purge to clean the coated surface of any unbound molecules. The roll to roll method may be supported by air flotation. The target speed of this process may be between 30 to 500 m/min.

The process of the present invention may also be performed by using a roll to roll method where the polymer dispersion coated paper-based flexible packaging material travels along a tunnel formed by TMA spray and $O_2$ purging nozzles, supported by air flotation.

The inventors have found that the process of the present invention leads to an $Al_2O_3$-coated paper with a water vapor transmission rate (WVTR) of below 5 $g/m^2/d$ at 38° C. and 90% RH. This represents a significant improvement compared to the polymer dispersion coated paper-based flexible packaging material without the $Al_2O_3$ coating.

The inventors were surprised to see that an $Al_2O_3$ coating with a thickness in the range of 20-30 nm applied to the surface of the polymer dispersion coated paper-based flexible packaging material resulted in an $Al_2O_3$-coated paper with a water vapor transmission rate (WVTR) of below 0.5 $g/m^2/d$ at 38° C. and 90% RH, and/or an oxygen transmission rate (OTR) of below 0.5 $cm^3/m^2/d$. Without wishing to be bound by theory, the inventors believe that this effect might be due to thinner $Al_2O_3$ coatings being more flexible and crack-resistant than thicker, more rigid films.

The subject matter of the present invention also includes the $Al_2O_3$-coated paper material obtainable by a process in accordance with the present invention and the $Al_2O_3$-coated paper material obtained by a process in accordance with the present invention. Hence, the subject matter of the present invention comprises a polymer dispersion coated paper-based flexible packaging material comprising an $Al_2O_3$ coating on at least one surface of the dispersion coated paper-based flexible packaging material.

As such the subject matter of the present invention comprises an Al2O3-coated paper material obtainable by a process in accordance with the present invention, where the polymer dispersion coating is one or a plurality of layers comprising acrylic acid copolymers, polyesters, polyhydroxyalkanoates, native and chemically modified starches, xylan and chemically modified xylan, polyvinylidene dichloride, polyvinyl alcohol, ethyl-vinyl alcohol, vinyl acetate, ethyl-vinyl acetates, cellulose nitrate, polyolefins, silanes, polyurethanes, or combinations thereof.

One preferred embodiment of the present invention relates to an $Al_2O_3$-coated polymer dispersion coated paper-based flexible packaging material, wherein the $Al_2O_3$ coating on the surface of the polymer dispersion coated paper-based flexible packaging material has a thickness in the range of 45-55 nm and the $Al_2O_3$-coated paper material has a water vapor transmission rate (WVTR) of below 5 g/m2d at 38° C. and 90% RH.

A further preferred embodiment of the present invention relates to an $Al_2O_3$-coated polymer dispersion coated paper-based flexible packaging material, wherein the $Al_2O_3$ coating on the surface of the polymer dispersion coated paper-based flexible packaging material has a thickness in the range of 20-30 nm and the $Al_2O_3$-coated paper material has a water vapor transmission rate (WVTR) of below 0.5 g/m2d at 38° C. and 90% RH.

Those skilled in the art will understand that they can freely combine all features of the present invention disclosed herein. In particular, features described for the product of the present invention may be combined with features described for the process of the present invention and vice versa. Further, features described for different embodiments of the present invention may be combined.

Although the invention has been described by way of example, it should be appreciated that variations and modifications may be made without departing from the scope of the invention as defined in the claims.

Furthermore, where known equivalents exist to specific features, such equivalents are incorporated as if specifically referred in this specification. Further advantages and features of the present invention are apparent from the figures and non-limiting examples.

Examples

Different substrates including two different commercially available papers were used. The substrates were taped with Kapton tape on glass during deposition for side-side coating (FIG. 1).

The substrates were processed in a Beneq P400 reactor at 70° C. with TMA and $H_2O$ as the precursors, and the plasma pre-treatment was done in an indirect plasma device (Asyntis Pioneer No. 1) before the deposition.

The plasma pre-treatment conditions were as follows: $O_2$ gas with 280 ml/min flow, base pressure 0.3 mbar, pulse time on/off: 0.50/2.50 msec, total processing time 1200 sec.

The process and corresponding WVTR results are shown in FIG. 2.

The invention claimed is:

1. A process for improving barrier properties of polymer dispersion coated paper-based flexible packaging materials comprising:

applying an $Al_2O_3$ coating having a thickness in the range of 8-70 nm, to at least one surface of the polymer dispersion coated paper-based flexible packaging material, wherein the $Al_2O_3$ coating is applied to the at least one surface of the polymer dispersion coated paper-based flexible packaging materials by atomic layer deposition at a temperature in the range of 40° C.-80° C. with trimethylaluminum (TMA) and $H_2O$ or $O_2$ as precursors, wherein the process further comprises a plasma pre-treatment of the at least one surface of the polymer dispersion coated paper-based flexible packaging materials before the $Al_2O_3$ coating is applied.

2. The process in accordance with claim 1, wherein the $Al_2O_3$ coating that is applied to the at least one surface of the polymer dispersion coated paper-based flexible packaging materials has a thickness in the range of 45-55 nm.

3. The process in accordance with claim 1, wherein the $Al_2O_3$ coating that is applied to the at least one surface of the polymer dispersion coated paper-based flexible packaging materials has a thickness in the range of 20-30 nm.

4. The process in accordance with claim 1, wherein the polymer dispersion coated paper-based flexible packaging materials has a grammage in the range of 40-120 $g/m^2$.

5. The process in accordance with claim 1, wherein the polymer dispersion coated paper-based flexible packaging materials is non-porous.

6. The process in accordance with claim 1, wherein the plasma pre-treatment of the at least one surface of the polymer dispersion coated paper-based flexible packaging materials is carried out with $O_2$ gas with a flow in the range of 250-300 ml/min.

7. The process in accordance with claim 1, leading to an $Al_2O_3$-coated paper with a water vapor transmission rate (WVTR) of below 5 $g/m^2/d$ at 38° C. and 90% RH.

* * * * *